US005797075A

United States Patent [19]

Saito et al.

[11] Patent Number: 5,797,075

[45] Date of Patent: Aug. 18, 1998

[54] IMAGE FORMING APPARATUS HAVING IMPROVED TONER CARRIER ARRANGEMENT

[75] Inventors: Masahiko Saito, Kitaibaraki; Toru Miyasaka; Kazushige Oonishi, both of Hitachi; Shoji Takeya, Tokai; Isamu Terashima, Hitachi; Tetsuro Akasaki, Hitachinaka; Tadashi Okano, Hitachi, all of Japan

[73] Assignee: Hitachi, Ltd., Tokyo, Japan

[21] Appl. No.: 814,339

[22] Filed: Mar. 11, 1997

[30] Foreign Application Priority Data

Mar. 14, 1996 [JP] Japan ..... 8-057197

[51] Int. Cl.[6] ..... G03G 15/08

[52] U.S. Cl. ..... 399/284; 399/281

[58] Field of Search ..... 399/222, 252, 399/265, 272, 273, 274, 279, 281, 283, 284, 254

[56] References Cited

U.S. PATENT DOCUMENTS 5,155,532 10/1992 Sakurada et al. ..... 399/284
5,177,323 1/1993 Kohyama ..... 399/222
5,253,019 10/1993 Brewington et al. ..... 399/281
5,255,059 10/1993 Kai et al. ..... 399/265
5,701,563 12/1997 Fukuda et al. ..... 399/284

*Primary Examiner*—S. Lee
*Attorney, Agent, or Firm*—Antonelli, Terry, Stout & Kraus, LLP

[57] ABSTRACT

A developing apparatus includes toner powder in the form of fine colored powder, a toner carrier, and a frictional controlling member for contacting under a pressure with the toner carrier under pressure to frictionally charge the toner powder and form a thin toner layer on the toner carrier. The toner carrier on which the thin toner layer is formed is rotated so as to transport the thin toner layer to an opposing location on a toner image carrier on which an electrostatic latent image is formed to convert the electrostatic latent image into a visible image. The developing apparatus includes a toner supply roller disposed in rotating contact with the toner carrier at a side of the toner carrier, the frictional controlling member being provided at a position in contact with the toner carrier downstream of the toner supply roller; and a rotatable toner scraping member is provided in a neighboring relationship below the toner supply roller and the frictional controlling member.

8 Claims, 2 Drawing Sheets

IMAGE FORMING APPARATUS HAVING IMPROVED TONER CARRIER ARRANGEMENT

BACKGROUND OF THE INVENTION

This invention relates to a one component developing apparatus, and more particularly to a developing apparatus which supplies toner powder to a toner carrier and forms the toner powder into a developing agent layer of a predetermined thickness by means of a frictional controlling member, whereby the developing agent layer is used to convert an electrostatic latent image on a photosensitive member into a visible image.

A conventional developing apparatus includes a controlling member having a face on the body thereof which is under pressure contact with a toner carrier to control the thickness of a layer of toner powder supplied to the toner carrier, as disclosed in Japanese Patent Publication Application No. Sho 63-16736. The free end of the controlling member on the upstream side thereof with respect to the direction of movement of the toner powder is alternatively contacted under a pressure in the reverse direction or in the forward direction.

Normally, the toner carrier is constructed such that it rotates in a direction opposite to the direction of rotation of a toner image carrier. This is because, when compared with an alternative case wherein the toner carrier is rotated in the same direction as the toner image carrier, the developing characteristic is improved, and where the direction of the rotation of the toner carrier is the same as that of the toner image carrier, vibrations or the like are likely to be produced because of an increase in load resistance. Therefore, the layer thickness controlling member for the toner carrier is normally provided above the toner carrier with respect to the center line of the toner carrier.

Another developing apparatus is disclosed in Japanese Patent Laid-Open Application No. Hei 5-134525 wherein, in order to feed toner powder remaining under a transport roller to the transport roller, a rotating roller is provided at a location positioned obliquely downwardly of the transport roller.

In the prior art developing apparatus, where the toner image carrier rotates, for example, in the clockwise direction, the toner carrier is located on the right side or the lower side and is rotated in the counterclockwise direction opposite to that of the toner image carrier. Consequently, the opposing faces of the carriers operate or move in the same direction. A paper path is located on the left side or the lower side. Consequently, a developing construction which is high in developing efficiency and is less likely to be affected by the problem of vibrations or the like is obtained.

However, the apparatus described above are directed to single color printing, and where, in order to effect color printing or the like, printing is performed by a plurality of developing operations in an overlapping relationship using an intermediate transfer member or the like, if the intermediate transfer member is rotated in the clockwise direction, then the toner image carrier is rotated in the counterclockwise direction and the toner carrier is rotated in the clockwise direction. Consequently, the toner carrier must transfer toner powder from the bottom side of a case. In short, the controlling face of the toner layer thickness controlling member must be positioned in a downward path of the toner image carrier. Therefore, the controlling face of the toner layer thickness controlling member must be located on the lower side with respect to the center line of the toner image carrier. In this instance, the surplus toner power remaining after the thickness of the toner powder layer is controlled drops and is accumulated on a rear face of the layer thickness controlling plate or the like. The toner powder accumulated there is not thereafter utilized at all unless some special drawing apparatus is provided.

Further, as such surplus toner powder drops and is accumulated over a period of time as described above, it is compressed to a high degree and forms a toner layer of an increasing thickness. Consequently, the toner powder cannot be charged to an appropriate charged voltage and a pressure fluctuation of the layer thickness controlling member is invited, which is the cause of irregularity in and a fluctuation of the thickness of the toner powder layer.

Meanwhile, although the apparatus of Japanese Patent Laid-Open Application No. Hei 5-134525 can eliminate such remaining toner powder as described above, since the layer thickness controlling member is located to the side of a toner supply roller, toner powder remains on the bottom side of the developing apparatus. Therefore, the structure of the bottom portion must be complicated so that toner powder will not remain there.

Further, in order to effect color printing, a plurality of developing units must be provided. For example, in order to provide four developing units, they must be formed with a reduced thickness. However, it is very difficult to provide such a toner drawing apparatus as described above having a reduced thickness construction.

Furthermore, where an end of the toner layer thickness controlling plate is a free end, the controlling face of the toner layer thickness controlling member is sometimes vibrated finely by a fluctuation in coefficient of friction between the toner carrier and the toner layer thickness controlling plate, which is the cause of a fluctuation in thickness of the toner layer.

Consequently, it is difficult for such a conventional apparatus as described above to form a thin toner layer of a unique thickness, which is essentially required for nonmagnetic one component development, stably for a long period of time.

SUMMARY OF THE INVENTION

It is an object of the present invention to provide a developing apparatus having a construction by which toner powder supplied to a toner carrier can be formed into a thin toner layer of a predetermined uniform thickness stably for a long period of time, and which is simple, thin and compact in construction and may be produced at a low cost is realized.

In order to attain the object described above, a toner supply roller positioned in rotating contact with a toner carrier is disposed at the side of the toner carrier in a developing apparatus. The toner supply roller has a resilient member, such as a urethane sponge or silicon sponge, formed on an outer periphery of a rotary shaft thereof and is rotated in contact with the toner carrier. A frictional controlling member is provided in contact with the toner carrier downstream of the toner supply roller, such that a fixed pressure may be exerted from pressing means which applies a pressure to bias the controlling member into forceful contact with the toner carrier. A rotatable toner scraping member is provided in a neighboring relationship below the toner supply roller and the frictional controlling member. The toner scraping member is formed from a toner transport member in the form of a sheet fixed to a rotary shaft or formed as a paddle or else formed from a round bar of approximately $\phi 2$ mounted, such that it rotates eccentrically from the center of the rotary shaft.

The positions of the frictional controlling member and the axis of rotation of the toner scraping member are located below a center axis of the toner carrier.

The angles of a toner seal member for preventing advancement of the toner powder to a face of the frictional controlling member opposite to a controlling face of the frictional controlling member which contacts the toner carrier, or the angle of the pressing means for applying a contacting pressure to bias the controlling face of the frictional controlling member into contact with the toner carrier and a toner seal member for preventing advancement of the toner powder to a location around the pressing means, and a wall of a case for supporting the seal member are inclined by 45 degrees or more so that the toner powder may be introduced smoothly to the toner scraping member. Here, as the toner seal member, a resilient member, such as a sponge or rubber plate or a thin plate in the form of a sheet (polyester film sheet, urethane sheet, nylon sheet or the like), is provided to eliminate a gap therearound, thereby to prevent advancement of the toner powder to the rear face of the frictional controlling member or to a location around the pressing means. Further, through the contact with a case member of the developing apparatus, the toner seal member exerts a suitable pressing force against the frictional controlling member, which pressing force acts upon a controlling face of the toner layer thickness controlling member.

Further, the developing apparatus has a thickness equal to or smaller than 50 mm so that four such developing apparatus, in which toner powder of four different colors is accommodated, can be arranged in a stacked relationship in an apparatus in order to allow color printing.

Since the toner supply roller contacting the toner carrier in the developing apparatus is disposed to the side of the toner carrier, the toner powder sticking to the toner supply roller is caused to stick and is supplied to the toner carrier. Since the frictional controlling member is provided in contact with the toner carrier downstream of the toner supply roller such that a fixed pressure may be exerted from the pressing means which applies a contacting pressure against the toner carrier, the toner powder is formed into a thin film. Here, the toner powder (by a surplus supply amount) remaining after the layer thickness of the toner powder is controlled by the frictional controlling member drops to the rear face of the layer thickness controlling plate. Thereafter, the surplus supply toner power is scraped out by the rotatable toner scraping member. Consequently, since no heap of surplus toner powder is produced in proximity to the controlling face of the toner layer thickness controlling member, a stable thin toner layer can be formed.

Further, since the positions of the frictional controlling member and the axis of rotation of the toner scraping member are located below the center axis of the toner carrier, the toner powder can be transported from the bottom side of the case of the developing apparatus.

Due to provision of the toner seal member for preventing advancement of the toner powder to the face of the frictional controlling member opposite to the controlling face of the frictional controlling member which contacts the toner carrier, or due to the provision of the pressing means for applying a contacting pressure to the toner carrier to bring the toner carrier and the controlling face of the frictional controlling member into contact and the toner seal member for preventing advancement of the toner powder to a location around the pressing means, admission of the toner powder is prevented and the pressing force is stabilized. Consequently, a normally stable thin toner layer can be formed.

Further, since the angle of the wall of the developing case which contacts the seal member is inclined by 45 degrees or more so that the toner powder may be introduced smoothly to the toner scraping member, surplus toner powder around the blade is scraped out by the rotatable toner scraping member, and no heap of surplus toner powder is produced around the controlling face of the toner layer thickness controlling member. Consequently, choking of the toner powder is eliminated, and the toner powder is prevented from being packed to a high degree, and accordingly, formation of a stable thin toner layer and appropriate charging of the toner powder can be attained.

Here, since the toner seal member exerts a suitable pressing force against the frictional controlling member through the contact thereof with the case member of the developing apparatus and the pressing force acts upon the controlling face of the toner layer thickness controlling member, fine vibrations which are produced upon fluctuation of the frictional force of the toner controlling face are absorbed and a suitable damper effect is obtained. Consequently, the developing apparatus is advantageous also in that the uniformity of the developed image is improved.

Further, since the developing apparatus is constructed with a thickness equal to or smaller than 50 mm, four such developing apparatus in which toner powder of four different colors required to effect color printing can be arranged in a stacked relationship in the apparatus.

DETAILED DESCRIPTION OF THE PREFERRED EMBODIMENTS

In the following, various embodiments of the present invention will be described with reference to the drawings.

Figure 3:
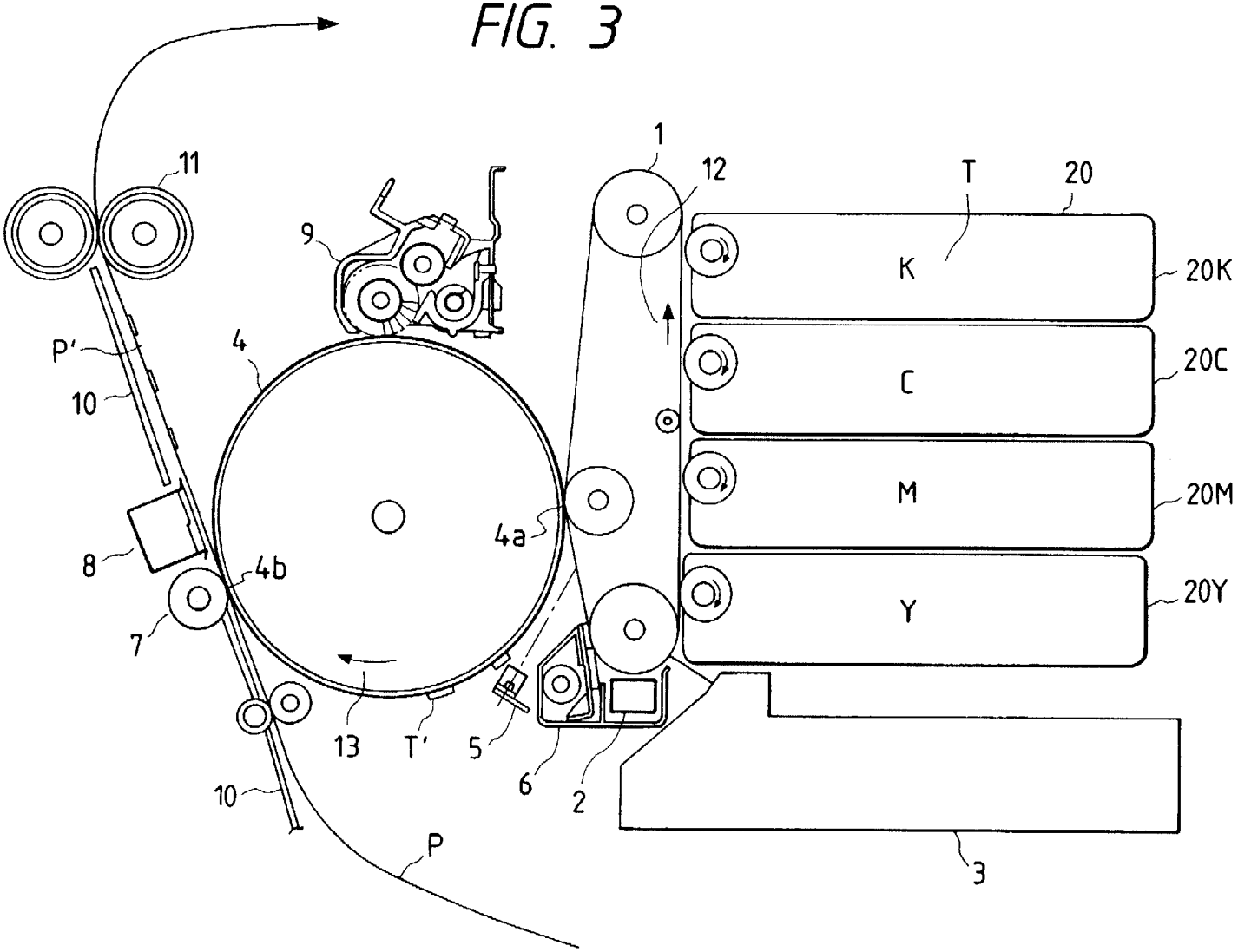
FIG. 3 is a vertical sectional view showing an embodiment of an electrophotographic apparatus of the type to which the present invention is directed.

FIG. 3 is a view showing a vertical section of an electrophotographic apparatus of the type to which the present invention is directed.

Referring to FIG. 3, the electrophotographic apparatus includes a photosensitive member in the form of a belt (hereinafter referred to simply as photosensitive member 1) serving as a toner image carrier, developing apparatus 20Y, 20M, 20C and 20K disposed adjacent an upward run of the photosensitive member 1 and having toner powder T of four different colors respectively filled therein, a charging apparatus 2 for charging the photosensitive member 1, an exposure apparatus 3 for exposing the surface of the photosensitive member 1 to light, an intermediate transfer member 4 disposed in a pressure contacting relationship with the photosensitive member 1, a remaining image erasure apparatus 5 for erasing a remaining image, and a photosensitive member cleaning apparatus 6 for cleaning the photosensitive member 1.

Further, disposed in order around the intermediate transfer member 4 are a transfer apparatus 7 for transferring a visible image to paper P, a paper exfoliation apparatus 8 for exfoliating the paper P to which the visible image has been transferred, and an intermediate transfer member cleaning apparatus 9 for cleaning the intermediate transfer member 4 to remove remaining toner power from the intermediate transfer member 4. Further, a paper transport path 10 is formed for passing the paper P through a transfer location **4*b* between the intermediate transfer member 4 and the transfer apparatus 7, and a fixing apparatus 11** is provided for fixing a toner image T', which has been transferred to paper P', to the paper P'.

The photosensitive member 1 is driven in the direction or arrow 12 by a driving mechanism not shown, and a photosensitive layer on the surface of the photosensitive member 1 is charged uniformly to the surface potential of −400 V to −600 V by the charging apparatus 2. Then, picture and/or character data from a personal computer, an image scanner or the like are imaged in units of a dot on the photosensitive member 1 by the exposure apparatus 3 to form an electrostatic latent image. Thereafter, the electrostatic latent image on the photosensitive member 1 is developed into a visible toner image by applying a developing bias voltage (a voltage higher by 100 V to 200 V than the surface potential) from a power supply not shown by means of a selected one of the developing units of the developing apparatus 20, whereafter the developed image is sent to a first transfer section **4*a***.

The photosensitive member 1 is connected to minus several hundreds volts by a power supply not shown, and the intermediate transfer member 4 is grounded. Consequently, at the first transfer section **4*a*, toner powder is transferred from the photosensitive member 1 to the intermediate transfer member 4** by the difference in potential.

After the photosensitive member 1 passes the first transfer section **4*a*, it is irradiated with light from the remaining image erasure apparatus 5 to erase the electrostatic latent image, whereupon the potential is dropped lower than a fixed level. Thereafter, remaining toner after the first transfer is removed by the photosensitive member cleaning apparatus 6** to prepare for a next printing operation.

When a color image is to be formed, the operation of the developing apparatus 20 for one cycle described above is successively repeated such that an operation of a desired cycle is performed in a timed relationship within each rotation of the intermediate transfer member 4 to allow overlapping of different color toner images on the intermediate transfer member 4.

Meanwhile, paper P is supplied in a timed relationship to the transfer section **4*b*, by which a toner image T' formed on the intermediate transfer member 4 by the operations described above is transferred to the paper P by an action of the transfer apparatus 7**.

Further, the paper P is exfoliated from the intermediate transfer member 4 by the paper exfoliation apparatus 8 and transported to the paper transport path 10, along which the toner image is molten and fixed to the paper P by the fixing apparatus 11, and then the paper P is discharged from a paper discharging station. Meanwhile, residual toner power remaining on the intermediate transfer member 4 after the toner image has been transferred to the paper P is removed by the intermediate transfer member cleaning apparatus 9, thereby preparing for a next printing operation.

Figure 1:
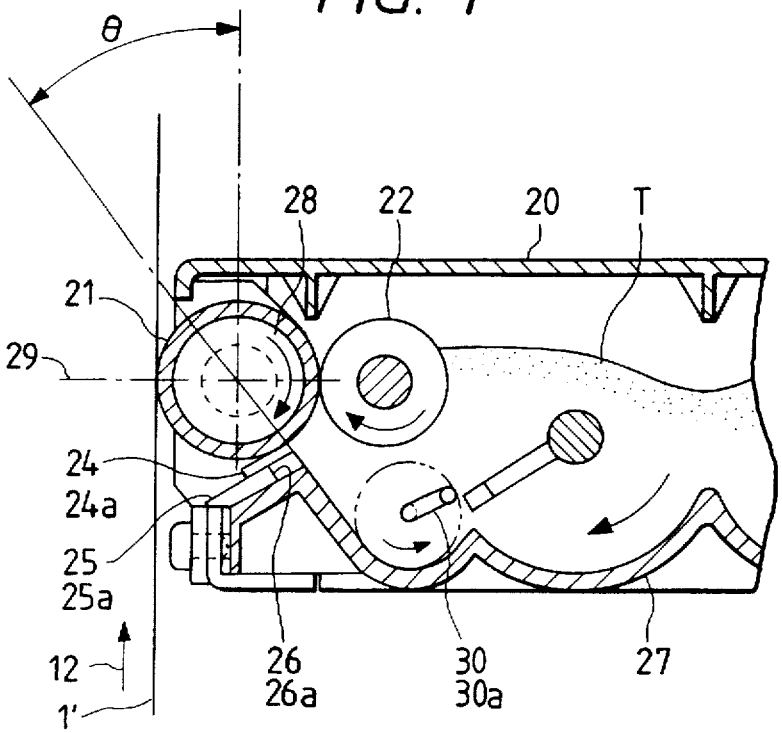
FIG. 1 is a vertical sectional view of a developing apparatus forming a first embodiment of the present invention.
Figure 2:
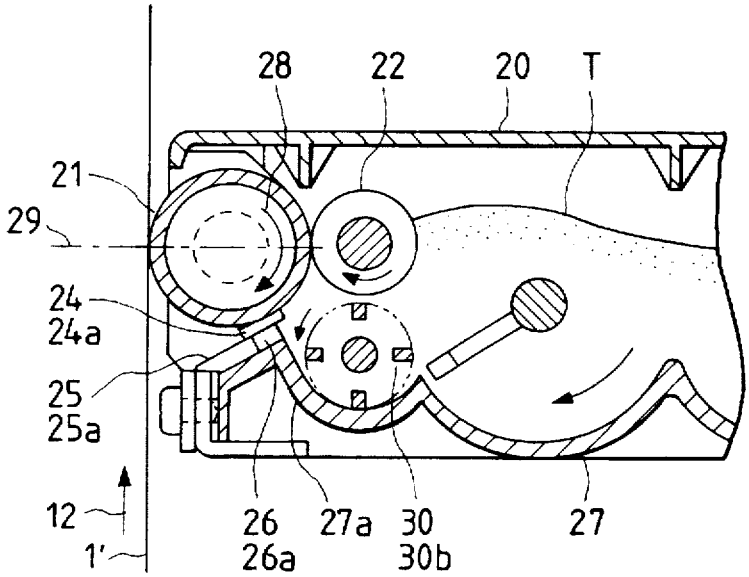
FIG. 2 is a vertical sectional view of a developing apparatus forming a second embodiment of the present invention.

FIGS. 1 and 2 show different embodiments of the developing apparatus 20 according to the present invention.

A photosensitive belt 1' of the photosensitive member 1 is driven upward in the direction of the arrow 12. A toner carrier 21 of the developing apparatus 20 is held in contact with, or held in a spaced relationship by approximately 0.1 to 1.0 mm from, the photosensitive belt 1' and is driven in a clockwise direction as indicated by the arrow 28. The toner carrier 21 is made of a conductive material, such as aluminum or stainless steel or a conductive rubber material. A toner supply roller 22 and a toner layer thickness controlling member 24 are located around the toner carrier 21. The toner layer thickness controlling member 24 is pressed under a suitable pressing force against the toner carrier 21 by pressing means 25. The pressing means 25 may be a leaf spring in the form of a thin plate of stainless steel, phosphor bronze or the like.

A frictional controlling member **24*a* of the toner layer thickness controlling member 24 may be formed from an extension of a leaf spring member 25*a* of the pressing means 25 and be directly in contact with the toner carrier 21, or it may have a two-layer structure wherein a rubber plate (urethane rubber, silicon rubber or the like) serving as the frictional controlling member 24*a* is fixed to the leaf spring member 25*a***.

A toner seal member 26 is disposed on the rear face of the toner layer thickness controlling member 24. The toner seal member 26 is formed from a resilient member **26*a*** made of a foamed sponge or rubber plate or the like, or a sheet material, such as a thin plate in the form of a sheet (polyester film sheet, nylon sheet, urethane sheet or the like).

The toner seal member 26 contacts the case member 27 of the developing apparatus 20 to eliminate a gap therearound to prevent admission of toner powder.

The toner seal member 26 is constructed such that it exerts a suitable pressing force through contact thereof with the case member 27 of the developing apparatus 20, which pressing force acts upon a controlling face of the toner layer thickness controlling member 24. Meanwhile, a wall **27*a* of the case member 27, which the toner seal member 26 contacts, is formed in an inclined relationship such that an angle θ thereof may be 45 degrees or more. Since the angle θ is 45 degrees or more, the toner powder T slides down smoothly on the wall so that it is introduced smoothly to a toner scraping member 30**.

The toner scraping member 30 is located for rotation in a neighboring relationship below the toner supply roller 22 and the frictional controlling member **24*a* of the toner layer thickness controlling member 24. The toner scraping member 30 is formed from a round bar 30*a* of approximately φ2 such that the round bar 30*a* may be rotated in an eccentric relationship from the center of the axis of rotation thereof. Or, the toner scraping out member 30 may be formed otherwise like a paddle, as denoted at 30*b* of FIG. 2**, or from a rotary shaft to which a toner transport member in the form of a sheet is affixed.

The frictional controlling member **24*a* of the toner layer thickness controlling member 24 and the toner scraping member 30 are located on the lower side with respect to the center line 29 of the toner carrier 21**.

Further, in order to form the developing apparatus 20 with a thickness smaller than 50 mm, the four developing apparatus 20, in which toner powder T of four different colors required for color printing is provided, are disposed in a stacked relationship with respect to each other in the electrophotographic apparatus. Here, the circumferential length of the photosensitive belt 1' and the intermediate transfer member 4 should preferably be set equal to or an integral number of times the circumferential length from the point of view of registration among the colors, and where printing, for example, for the A3 paper size is to be performed, the circumferential length should be set to a length approximately equal to approximately 450 mm of the A3 paper size plus α.

The photosensitive belt 1' must be extended and folded back along the photosensitive member 1 as seen in FIG. 1, and the length of a flat portion of it along which the developing apparatus 20 are disposed is approximately 200 mm. Thus, in order to dispose the four developing apparatus 20 in a stacked relationship, the thickness of the developing apparatus 20 must be set equal to or smaller than 50 mm.

Now, operation of the developing apparatus 20 of the foregoing embodiments will be described.

In the developing apparatus 20, since the toner supply roller 22, which is held in rotating contact with a side portion of the toner carrier 21, is located to the side of the toner carrier 21, the toner powder T sticking to the toner supply roller 22 is caused to stick to the toner carrier 21 to supply the toner powder T. Since the pressing means 25 for applying a contacting pressure to the toner carrier 21 is disposed on the downstream side of the toner supply roller 22 and the frictional controlling member 24*a* is disposed so that a fixed pressure may be applied to the toner carrier 21, the toner powder T is formed into a thin layer on the toner carrier 21. Here, surplus toner powder T remaining after the layer thickness is controlled by the toner layer thickness controlling member 24 drops to the rear face of the frictional controlling member 24*a*. Thereafter, the surplus toner powder T is scraped by the rotatable toner scraping member 30. Consequently, since no heap of the surplus toner powder T is produced in the proximity of the frictional controlling face 24*a* of the toner layer thickness controlling member 24, a thin toner layer can be formed stably and the toner powder can be charged appropriately.

In a printing test conducted for 10,000 paper sheets using the developing apparatus 20 of the present embodiment, a stability for a long period of time was achieved with a thin toner layer of 0.05±0.05 mg/cm$^2$ and a toner charge amount of 10 to 15 μ/g.

Further, since the frictional controlling member 24*a* of the toner layer thickness controlling member 24 and the toner scraping member 30 are located on the lower side with respect to the center line 29 of the toner carrier 21, the toner powder T can be transported from the case bottom side of the developing apparatus 20.

Meanwhile, the toner seal member 26 for blocking admission of toner powder is disposed on the face of the toner layer thickness controlling member 24 opposite to the face of the frictional controlling member 24*a* which contacts with the toner carrier 21, so that admission of toner powder may be prevented. Since this can prevent advancement of toner power to the face of the toner layer thickness controlling member 24 opposite to the face of the frictional controlling member 24*a* which contacts the toner carrier 21 and the entrance of the toner power to a location around the pressing means 25, the pressing force to the toner powder is stabilized, and formation of a stable thin toner layer and appropriate charging of the toner powder can be achieved.

Further, the developing apparatus 20 is constructed such that the angle of the case member 27 which contacts the seal member 26 has an inclination equal to or larger than 45 degrees so that toner powder may be introduced smoothly to the toner scraping member 30. Consequently, since the toner powder T supplied by a surplus amount to a location around the blade is scraped out by the rotatable toner scraping member 30 and no heap of surplus toner powder is produced around the frictional controlling member 24*a* of the toner layer thickness controlling member 24, choking of the toner powder T is prevented and the toner powder is prevented from being compressed to a high degree. Consequently, formation of a stable thin toner layer and appropriate charging of the toner powder can be achieved.

Here, since the toner seal member 26 contacts the case member 27 of the developing apparatus to exert a suitable pressing force which acts upon the frictional controlling member 24*a* of the toner layer thickness controlling member 24, fine vibrations which are produced upon fluctuation of the frictional force of the frictional controlling member 24*a* are absorbed and a suitable damper effect is obtained. Consequently, an image which is improved in uniformity is obtained.

According to the present invention, since the pressing force of the toner layer thickness controlling member 24 can be held stably even if toner powder is transported from the case bottom side of the developing apparatus 20 described above, uniform contact with the toner carrier 21 can be achieved, which allows formation of a stable thin toner layer and stable charging of desired toner powder. Consequently, a developing apparatus can be provided in which a one component developing apparatus suitable for maintenance by a user can be formed with a small thickness, a compact size, a simple construction and at a low cost.

What is claimed is:

1. A developing apparatus which includes toner powder in the form of fine colored powder, a toner carrier, and a frictional controlling member for contacting said toner carrier under pressure to frictionally charge said toner powder and form a thin toner layer on said toner carrier, and wherein said toner carrier on which the thin toner layer is formed is rotated so as to transport the thin toner layer to a location where it may be transferred onto a toner image carrier on which an electrostatic latent image is formed to convert the electrostatic latent image into a visible image, said developing apparatus comprising: a toner supply roller disposed in rotating contact with said toner carrier at a side of said toner carrier, said frictional controlling member being provided at a position in contact with the toner carrier downstream of said toner supply roller with respect to a direction of rotation of said toner carrier; and a rotatable toner scraping member provided in a neighboring relationship below said toner supply roller and said frictional controlling member.

2. A developing apparatus according to claim 1, wherein positions of said frictional controlling member and an axis of rotation of said toner scraping member are located below a center axis of said toner carrier.

3. A developing apparatus according to claim 1, further including a toner seal member for preventing advancement of said toner powder to a face of said frictional controlling member opposite to a controlling face of said frictional controlling member which contacts with said toner carrier, a portion of a wall of a case on which said seal member is supported extending away from said seal member at an angle of 45 degrees or more toward said scraping member relative to a vertical axis of said toner carrier.

4. A developing apparatus according to claim 1, wherein said frictional controlling member includes pressing means for applying a contacting pressure to cause a controlling face of said frictional controlling member to contact said toner carrier, and a toner seal member for preventing advancement of said toner powder to a location around said pressing means, a portion of a wall of a case for supporting said seal member extending away from said seal member at an angle of 45 degrees or more toward said scraping member relative to a vertical axis of said toner carrier.

5. A developing apparatus according to claim 1, wherein said developing apparatus has a thickness equal to or smaller than 50 mm.

6. A developing apparatus which includes toner powder in the form of fine colored powder, a toner carrier, and a frictional controlling member for contacting said toner carrier under pressure to frictionally charge said toner powder and form a thin toner layer on said toner carrier, and wherein said toner carrier on which the thin toner layer is formed is rotated so as to transport the thin toner layer to a location where it may be transferred onto a toner image carrier on which an electrostatic latent image is formed to convert the electrostatic latent image into a visible image, said developing apparatus comprising: a toner supply roller disposed in rotating contact with said toner carrier at a side of said toner carrier, said frictional controlling member being provided at a position in contact with the toner carrier downstream of said toner supply roller with respect to a direction of rotation of said toner carrier; and a toner seal member for preventing advancement of said toner powder to a face of said frictional controlling member opposite to a controlling face of said frictional controlling member which contacts with said toner carrier.

7. A developing apparatus according to claim 6, wherein an angle of a portion of a wall of a case for supporting said toner seal member is inclined by 45 degrees or more away from said toner seal member relative to a vertical axis of said toner carrier.

8. A developing apparatus according to claim 7, said frictional controlling member comprising pressing means for applying a contacting pressure to cause a controlling face of said frictional controlling member to control said toner carrier.

* * * * *